US005916512A

United States Patent [19]

Arutyunov et al.

[11] Patent Number: 5,916,512

[45] Date of Patent: Jun. 29, 1999

[54] METHOD AND APPARATUS FOR AFTER-BURNING THE COMBUSTIBLE COMPONENTS OF THE ATMOSPHERE IN METALLURGICAL SMELTING VESSELS

[75] Inventors: Vladimir Alexandrovich Arutyunov; Alexander Yakovlevich Stomakhin; Alexei Varnavievich Yegorov; Vladimir Ilyich Lebedev; Vladimir Andreyevich Romenets; Valery Sergeyevich Valavin, all of Moscow; Dmitry Dmitryievich Kozlov, Lipetsk; Gennady Borisovich Beremblum, Lipetsk; Valentin Andreysvich Breus, Lipetsk; Boris Anatolievich Chumarin, Lipetsk; Oleg Petrovich Lopatin, Lipetsk, all of Russian Federation

[73] Assignee: Air Products and Chemicals, Inc., Allentown, Pa.

[21] Appl. No.: 08/981,345

[22] PCT Filed: Jun. 28, 1996

[86] PCT No.: PCT/US96/11129

§ 371 Date: Mar. 27, 1998

§ 102(e) Date: Mar. 27, 1998

[87] PCT Pub. No.: WO97/02364

PCT Pub. Date: Jan. 23, 1997

[30] Foreign Application Priority Data

Jul. 6, 1995 [RU] Russian Federation ..... 95111681

[51] Int. Cl.[6] ..... C21C 5/28; C21C 5/52

[52] U.S. Cl. ..... 266/47; 266/217; 266/225; 266/265

[58] Field of Search ..... 75/501, 502; 266/255, 266/226, 265, 268, 270, 217, 47

[56] References Cited

U.S. PATENT DOCUMENTS

| | | | |
|---|---|---|---|
| 3,488,044 | 1/1970 | Shepherd . | |
| 3,697,058 | 10/1972 | Chaikin et al. . | |
| 4,957,545 | 9/1990 | Hikosaka et al. | 75/501 |
| 5,050,848 | 9/1991 | Hardie et al. . | |
| 5,051,127 | 9/1991 | Hardie et al. . | |
| 5,166,950 | 11/1992 | Jouvaud et al. . | |
| 5,308,043 | 5/1994 | Floyd et al. | 266/225 |
| 5,375,139 | 12/1994 | Bender . | |
| 5,498,277 | 3/1996 | Floyd et al. | 75/501 |
| 5,647,888 | 7/1997 | Keough et al. | 75/501 |

FOREIGN PATENT DOCUMENTS

| | | |
|---|---|---|
| 0446860 A1 | 9/1991 | European Pat. Off. . |
| 0544044 A1 | 6/1993 | European Pat. Off. . |
| 84-010356/02 | 3/1983 | Russian Federation . |

OTHER PUBLICATIONS

Search Report Jul. 6, 1995.

*Primary Examiner*—Scott Kastler
*Attorney, Agent, or Firm*—Ratner & Prestia

[57] ABSTRACT

Method and apparatus for post-combustion (after-burning) of the combustible gases present in a metallurgical vessel used for smelting metals. A swirling flow of an oxidizing gas emanating from a radiant injector (10) having a funnel-shaped (conical) diffuser (14) causes a reaction between the combustible gases and the oxidizing gas at the inner surface (13) of the diffuser (14) thereby further heating the inner surface (13). Heat from the inner surface (13) of the diffuser (14) is radiated inside the vessel toward the metal (12). Fuel gas can be supplied to the radiant injector to aid in heating of the inner surface (13) of the diffuser (14).

10 Claims, 1 Drawing Sheet

METHOD AND APPARATUS FOR AFTER-BURNING THE COMBUSTIBLE COMPONENTS OF THE ATMOSPHERE IN METALLURGICAL SMELTING VESSELS

FIELD OF THE INVENTION

The invention concerns the field of metallurgy, more specifically, the processes and equipment for the post combustion of the atmosphere gases in smelting installations.

BACKGROUND OF THE INVENTION

The term "post combustion" is also known in the art as "after-burning". Therefore, these terms will be used interchangeably in this application.

A known method for post combustion of combustible components in the atmosphere in steel smelting vessels includes, feeding a jet of oxygen through an oxygen lance into the working space of the steel smelting unit (vessel) above the level of the metal in the vessel. In this method, the oxygen is fed through an apparatus having several rows of outlets in the form of jets which are aimed in a direction which is inclined with respect to the horizontal plane. The outlets are positioned at different levels in the vessel or furnace.

The apparatus includes an oxygen lance in the form of concentric pipes for the introduction of oxygen into the vessel, and for providing cooling water for the apparatus. At the discharge end of the lance apparatus and extending along its length, blowholes are positioned for the oxygen, in the form of jets, to exit the lance. Such a device is shown by E. D. Merker in his publication "*Gas Dynamic Protection of the Blasting Zone in Steel Smelting Installations*," Moscow, Metallurgiya, 1994, at page 20, FIG. 5.

A disadvantage of using the known device is the low efficiency seen in both the process of post combustion (after-burning) of the gases evolving in the steel smelting unit and in the creation of a gas dynamic curtain.

Due to the fact that the jets are discrete entities, the necessary intermixing of the furnace atmosphere with the oxygen jets does not take place. Moreover, when the known method and device are used, the heat evolving during the after-burning of the combustible components is not returned to the molten metal. The discrete feeding of oxygen in separate jets does not create a continuous gas dynamic curtain over the metal bath. Under these conditions the efficiency of after-burning of the combustible components will not exceed 50–60%.

U.S. Pat. Nos. 5,050,848 and 5,051,127 disclose an apparatus and method for post combustion over a molten bath using a swirling gas flow by means of one or more tuyeres directed at the surface of the metal.

U.S. Pat. No. 5,166,950 discloses a process for post combustion (after-burning) in a metallurgical furnace.

European Patent Publication 0 544 044 A1 discloses another post combustion process.

SUMMARY OF THE INVENTION

The method and apparatus of the present invention introduces an oxygen-containing gas, e.g., purity oxygen, into a metallurgical (e.g., steel) smelting (melting) vessel or furnace, above the level of the metal in a tangential swirling flow that is generally parallel to the bath portion of the furnace. The oxygen, thus introduced into the furnace, creates a continuous gas dynamic curtain of oxygen in the form of a fan-like jet above the metal. Introduction of the oxygen-containing gas is facilitated by means of a radiant injector having a diffuser with the cross-sectional shape of an inverted (relative to the metal in the furnace) funnel, wherein the oxygen-containing gas is introduced tangentially in a capped cylindrical portion located at and communicating with the open apex end of the funnel so that the gas swirls downwardly and outwardly from the funnel to form the dynamic gas curtain and react with the gases in the furnace (vessel) to effect post combustion (after-burning) of the combustible components of the furnace atmosphere at the inner surface of the diffuser thereby further heating the inner surface of the diffuser, which heat is radiated onto the metal contained in the furnace.

DETAILED DESCRIPTION OF THE INVENTION

Figure 1:
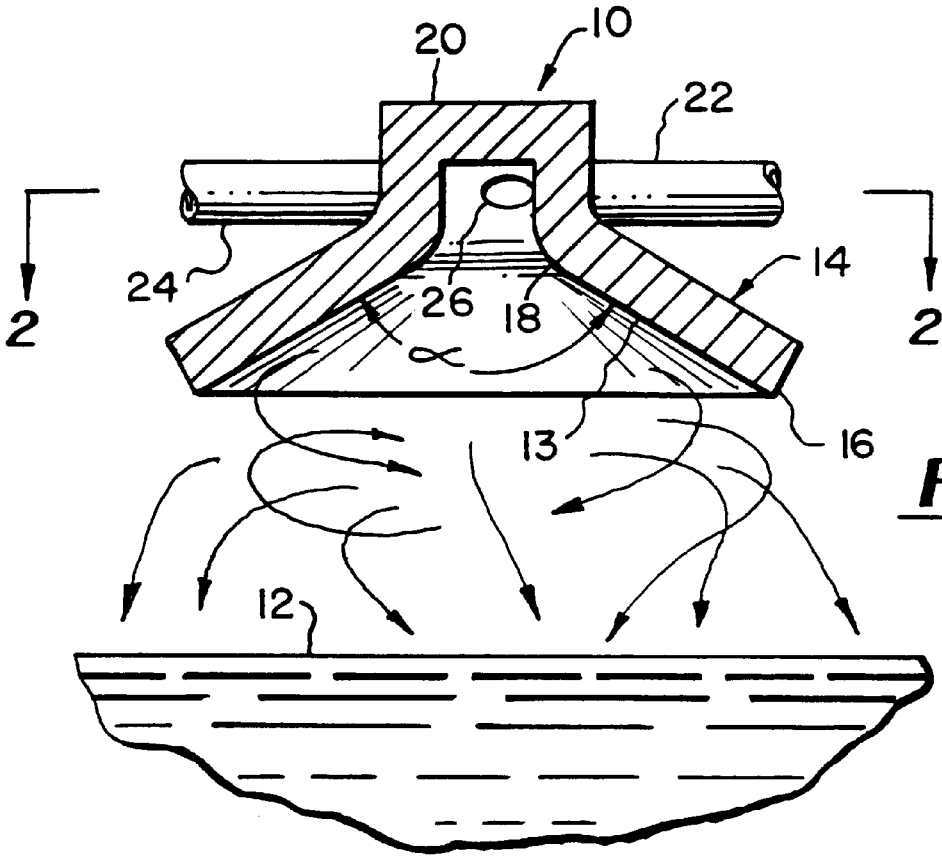
FIG. 1 is schematic representation of the method and apparatus of the invention.
Figure 2:
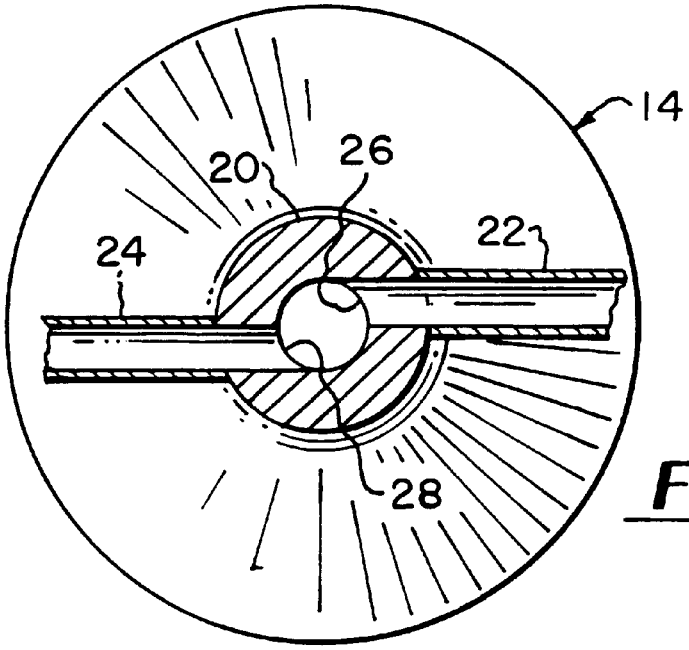
FIG. 2 is view taken along line 2—2 of FIG. 1.

Referring to FIG. 1, the radiant injector apparatus of the invention is shown generally as 10 and is disposed over bath 12 of molten metal contained in a melting or smelting furnace or vessel (not shown). Radiant injector 10 and method of the invention can be used in any conventional furnace such as a basic oxygen furnace (BOF), electric arc furnace (EAF), open hearth furnace or any other furnace or vessel where there is an atmosphere space above the metal. The method and apparatus of the invention can be used during all or part of any smelting process. As shown in FIG. 1, apparatus 10 includes first portion (diffuser) 14 having a cross-sectional (longitudinal-section) shape of a funnel with wide opening 16 of diffuser 14 disposed over and generally parallel to bath 12. The apex 18 of diffuser 14 terminates in a capped cylindrical portion 20. Capped cylindrical portion 20 is fitted with two (2) oxygen-containing gas supply pipes 22 and 24, which terminate in elliptical shaped passages or discharge openings 26 and 28 inside of cap shaped cylindrical portion 20. Although FIG. 1 is illustrated with two (2) oxygen-containing gas supply pipes, it is only necessary to have at least one (1) oxygen-containing gas supply pipe.

The body of diffuser 14 is designed with an angle for funnel mouth 16 within the limits of 140–179°. The body of diffuser 14 can be made from refractory material such as corundum, mullite-corundum or periclase chromite. In addition, the body of diffuser 14 can be made of metal and be water cooled with the inner surface of diffuser 14 being covered with a refractory material.

In operation, the radiant injector device 10 is installed inside the vessel facing metal 12 as shown in FIG. 1. Oxygen-containing gas, e.g., pure oxygen, is introduced into device 10 via conduits 22 and 24 and nozzles 26 and 28 from the oxygen supply (not shown). The oxygen-containing gas swirls downwardly from capped cylindrical portion 20 expanding outwardly to contact the inner conical surface 13 of diffuser 14. As the oxygen-containing gas swirls downwardly and outwardly, the centrifugal force in combination with Coanda effect acts to make the flow expand along adjacent inner surface 13 resulting in the inducement of a partial vacuum in the axial region of diffuser 14.

This partial vacuum causes the furnace atmosphere to be drawn into the swirling oxygen-containing gas where combustible species, e.g., carbon monoxide and hydrogen, in the furnace atmosphere can be burned. Further, the hot inner surface 13 can promote catalytic combustion of such carbon monoxide and hydrogen present in the atmosphere. In addition to combustion, diffuser 14 becomes a radiation heat source for the furnace.

An increase in the efficiency of the post combustion (after-burning) process of the combustible components of the atmosphere in steel smelting vessels can be accomplished as a result of the creation of a continuous gas dynamic curtain of oxygen in the form of a "fan-like" jet above the metal. At this time, intensive catalytic combustion of carbon monoxide and hydrogen occurs on the ceramic surface of diffuser 14. In addition, there is intensive radiation onto the metal from the surface of the diffuser. Under these conditions, the discrete spectrum of the gas radiation from carbon dioxide and water molecules is transformed into a continuous spectrum of radiation from the surface of the diffuser. The swirling tangentially guided jets of oxygen create the necessary vacuum in the axial region of the diffuser, thus assuring intensive inflow of the combustible components of the atmosphere toward the stream of oxygen on inner surface 13 of diffuser 14.

The range of values of the opening angle of the diffuser 14 within the limits of 140–179° can be explained by gas dynamic and heat radiation laws. Angles within this range allow for the formation of a layer of oxygen on the surface of the diffuser from oxygen fed onto the inner surface of the diffuser in a tangential direction. At smaller angles, i.e., less than 140°, a stable flow of oxygen along the diffuser surface cannot be assured. At greater angles, i.e., greater than 179°, no radiation will be directly radiated from the refractory surface of the diffuser onto the metal. The specific angle is determined as a direct function of the diameter of the working space of the furnace.

The diffuser is manufactured from refractory material to enhance its resistance and increase its service life under conditions of high temperatures and spattering molten metal present in the furnace.

The presence of the capped cylinder at the top of the diffuser prevents entrainment of gases from the space above the radiant injector.

The apparatus and method according to the invention can be further amplified by reference to the following illustration:

For example, during the melting of a typical carbon structural steel having a carbon content between 0.14 and 0.22 percent by weight (Russian steel specification St3) in an electric arc furnace, several radiant injectors 10 can be mounted for the post combustion (after-burning) of the combustible components of the atmosphere formed in the working space of the furnace above the metal. Between two (2) and ten (10) radiant injectors 10 can be positioned in the electric arc furnace, e.g., in the top (roof) of the furnace, on the walls around the perimeter of the working space of the furnace or around the electrodes. The radiant injectors can also be introduced through the slag door of the electric arc furnace.

In this illustration, the number of oxygen supply pipes is two (2) and the velocity of oxygen exiting the nozzle is between 50–200 meters per second (m/s).

In this illustration, the outer diameter of diffuser 14 is 600 mm, the inner diameter of the capped cylinder 20 is 100 mm, the height of the capped cylinder 20 is 100 mm, and the internal diameter of the pipes 22 and 24 is 25 mm.

By feeding the oxygen tangentially through pipes 22 and 24 into the internal cavity of capped cylinder 20, a swirling flow of oxygen is created, which upon exiting from the capped cylinder 20, as a result of gas dynamic laws, spreads out in a continuous layer over the inner surface 13 of the diffuser 14, and when existing diffuser 14 creates a continuous gas curtain over metal 12. In this case, in the axial region of the diffuser, a vacuum is created which leads to the entrainment of the atmosphere containing the combustible components. As the mixture of oxygen and combustible components moves along the inner surface of the diffuser, intensive combustion takes place. Under these conditions the body of the diffuser 14 radiates and reflects radiant energy in the direction of the metal 12, thus increasing the temperature of slag and metal. The gas layer resulting from the hot mixture also protects the diffuser from spattered droplets of liquid metal and/or slag .

The use of the proposed method and device (i.e., achieving its industrial benefit) can permit an increase in the overall efficiency of post combustion (after-burning) of the combustible components of the atmosphere in steel melting installations by thirty to forty percent (30–40%).

For the periods when there is no carbon monoxide and/or hydrogen in the furnace atmosphere or to prevent thermal shock to the refractory of the radiant injector when the furnace is opened, the radiant injector 10 may be equipped with an outside source of fuel (e.g., natural gas) to maintain its temperature. For this purpose, a water-cooled gas (or fuel) feeder can be located in the capped cylinder portion 20 of radiant injection 10. The flow of natural gas (or other fuel) should be rotating in the same direction as the oxygen flow.

We claim:

1. A process for post combustion of combustible gases present in a metallurgical furnace used to melt metals comprising the steps of:

installing in said furnace at least one radiant injector having a diffuser in the general shape of an inverted funnel having an inner refractory surface portion positioned juxtaposed to a metal containing portion of said furnace, an apex, and a capped cylindrical portion closing an opening in the apex of said funnel;

introducing an oxygen-containing gas tangentially into said capped cylindrical portion;

continuing flow of said oxygen-containing gas in order to create a swirling flow of oxygen-containing gas exiting downwardly and outwardly from said diffuser, whereby, as said oxygen-containing gas swirls downwardly and outwardly from said diffuser, said gas flow expands along said inner refractory surface of said diffuser resulting in furnace atmosphere being drawn into said swirling oxygen-containing gas to effect burning of combustible species in said furnace atmosphere, thereby increasing the temperature of the inner refractory surface of said diffuser which then radiates heat into said furnace.

2. A process according to claim 1 wherein said funnel-shaped diffuser has an opening angle between 140 and 179°.

3. A process according to claim 1 including the step of installing a plurality of radiant injectors in said furnace.

4. A process according to claim 1 including the step of introducing fuel into said radiant injector to maintain the temperature of said inner surface of said diffuser during periods when the quantity of the combustible gases is diminished or to prevent thermal shock to said inner, refractory surface when the furnace is opened.

5. A radiant injector for introducing a post combustion oxidizing gas into a metallurgical furnace comprising:

a funnel-shaped diffuser having a flared end and an apex end, said apex end having a generally circular opening, said diffuser adapted to be installed in said furnace with said circular opening facing a metal containing portion of said furnace, a capped cylindrical portion disposed on said apex end, the interior of said capped cylindrical portion communicating with said opening; and means to introduce the oxidizing gas tangentially into said capped cylindrical portion.

6. A radiant injector according to claim 5 wherein said funnel-shaped diffuser has an opening angle between 140 and 179°.

7. A radiant injector according to claim 5 wherein said funnel-shaped diffuser is fabricated from a high temperature refractory material.

8. A radiant injector according to claim 5 wherein said funnel-shaped diffuser is fabricated from a metal with the inner surface of said funnel-shaped diffuser lined with a high temperature refractory.

9. A radiant injector according to claim 5 wherein at least said cylindrical portion is water cooled.

10. A radiant injector according to claim 5 including means to introduce a fuel into said radiant injector.

* * * * *